United States Patent [19]

Savageau

[11] 4,179,773

[45] Dec. 25, 1979

[54] MEANS FOR SEVERING AND COMPACTING COILED SLIVER

[75] Inventor: Richard J. Savageau, Seneca, S.C.

[73] Assignee: Platt Saco Lowell Limited, United Kingdom

[21] Appl. No.: 900,559

[22] Filed: Apr. 27, 1978

[51] Int. Cl.[2] ..... D65H 54/84

[52] U.S. Cl. ..... 19/159 A

[58] Field of Search ..... 19/159 R, 159 A, 157; 53/13, 116, 124 B; 100/53

[56] References Cited

U.S. PATENT DOCUMENTS

| | | | |
|---|---|---|---|
| 911,297 | 2/1909 | Dawson | 53/13 X |
| 3,357,346 | 12/1967 | Crafoord | 53/124 B X |

FOREIGN PATENT DOCUMENTS

| | | | |
|---|---|---|---|
| 751409 | 6/1933 | France | 19/159 A |

*Primary Examiner*—Louis Rimrodt

*Attorney, Agent, or Firm*—Donald H. Feldman; Joseph H. Heard

[57] ABSTRACT

In combination with a sliver coiler and can changer apparatus, a sliver compactor and severing device is provided which concurrently compacts coiled sliver and separates, parts or severs through attenuation the ultimate strand portion extending between the filled sliver can and the coiler. The combination is provided with control means which coordinates the elements to stop can filling upon sensing that a predetermined amount of sliver has been delivered to the can, to exchange the filled can for an empty one beneath the coiler and position the filled can beneath the compactor plate or ram of the means, to compact the sliver at a specified rate wherein sliver disruption is avoided while, through a safety shroud, covering the space between the can rim and the compactor spectacle plate, to restart sliver coiling in the empty can while maintaining compaction of the sliver in the filled can, and then to withdraw the plate from the filled can at a predetermined time prior to completion of filling the second and formerly empty can.

5 Claims, 4 Drawing Figures

MEANS FOR SEVERING AND COMPACTING COILED SLIVER

BACKGROUND OF THE INVENTION

1. Field of the Invention

Figure 1:
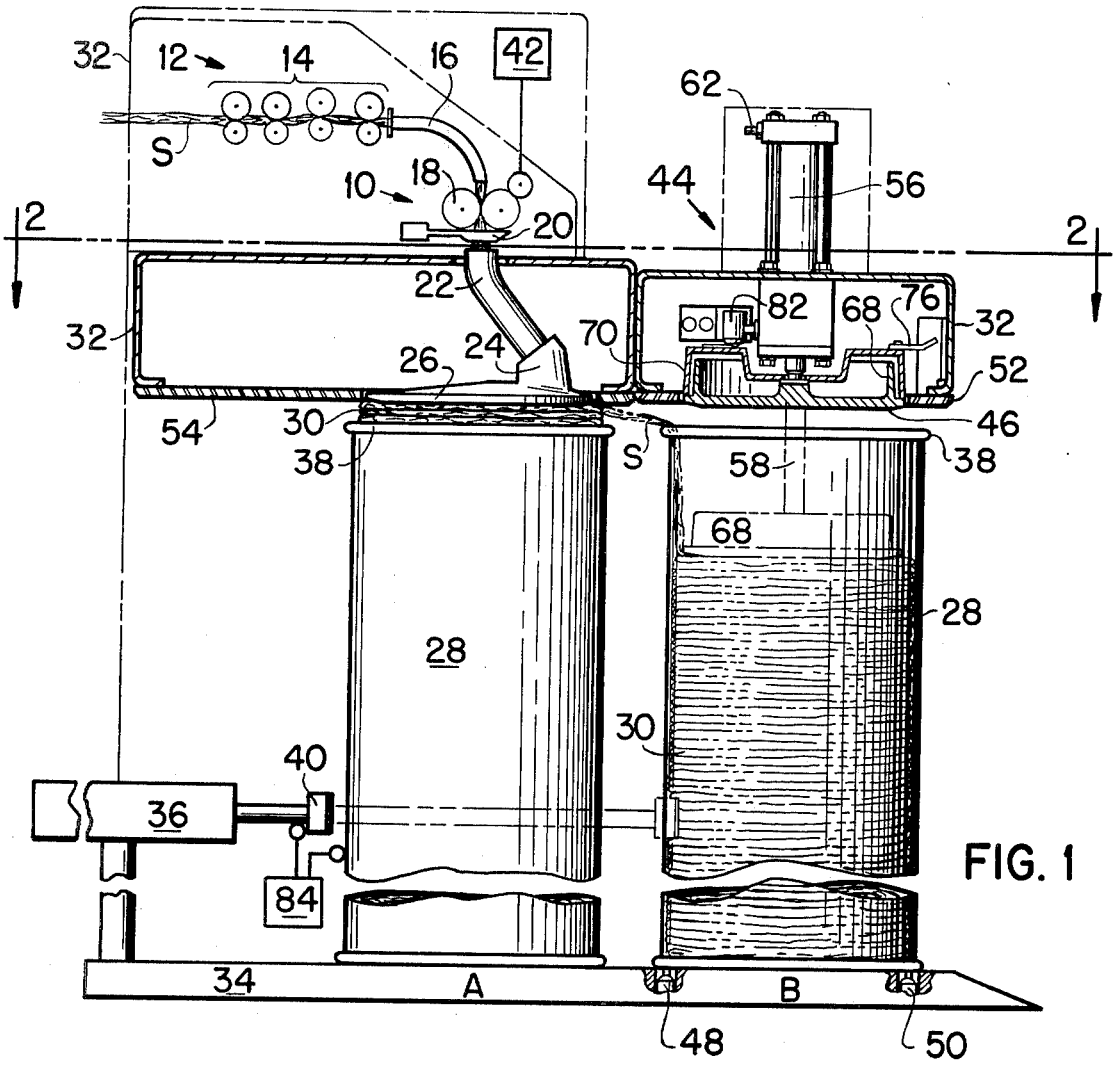

This invention relates generally to the automatic processing of can-packed textile sliver strands, from sliver coiling, can-packing with coiled sliver, can-changing, sliver severing of the strand between the filled can and the coiler, to a compaction of sliver in the filled can. In particular, the invention relates to a joining in operative combination of prior art coiler and can changer with a sliver compactor of special construction which in such combination acts automatically both to sever the sliver strand and compact the sliver, such operative combination being effected by a simple and reliable control means.

2. The Prior Art

With the ever growing demand for increased productivity at every stage in the processing of staple fibers to textile goods, various proposals have been made to couple by automatic means sundry concurrent or sequential processing steps toward the goal to produce more product at less cost and waste.

Especially resistant to such coupling and thus one of the "slow" steps in processing staple fibers has been the handling of sliver between processing machines by cans, such as for example between drawing frames in first and second stage drawing, or between second stage drawing and a roving frame or an open end spinner, or between a card and a draw frame or a comber. In this, the sliver may be passed through a drafting unit and condensed, coiled by a coiler apparatus and delivered as coiled strand into a can. The art is replete with disclosure of many types of can changers which automatically, upon sensing that a can had received either a predetermined weight, volume or length of sliver strand, will move the can out from under the coiler apparatus and move an empty can thereunder whereupon the coiling process may be continued.

Ancillary to can changing, whether by either manual or automatic means, is the need to sever the ultimate portion of the sliver strand which extends from the top of the filled can to the coiler apparatus. Failure to part the strand prior to beginning to fill the next empty can results in disruption of the top coils of sliver in the filled can and the bottom coils of the next can, and often the discharge of sliver onto the floor, in all creating production delays and product waste. Means for coupling automatic can changing with sliver severing also have long been known in the art and are of widely diverse sorts, as disclosed for example by British Pat. Nos. 370,081; 888,070; 829,507; 1,014,960; and 1,236,213; and by U.S. Pat. Nos. 3,249,968; 3,382,543; 3,435,485; and 3,991,443.

The limited capacity of sliver cans combined with the very open structure of the coils of sliver strand and their high resiliency have long been recognized to be inherent qualities which are inimical to attaining the aforesaid goal, and produce severe problems in providing physical means for sliver handling which include that of use of large numbers of cans, provision of storage space for cans between uses and capital investments related to maintaining a large store of cans and their replacement. These problems have been greatly aggravated in more recent times with technological advances made in increasing production rates of the fiber and sliver processing machinery. For example, with the advent of open end yarn spinners which can spin yarn at rates of three to ten times that of ring and traveller spinning machines, and the trend in their development to enormously increased rotor speeds and thus further increases in rates of yarn production, per unit of production time the numbers of cans needed to supply sliver to such machines over those required to supply the pre-processing machines for ring spinning are from three to over ten fold. Moreover, many open end yarn spinning machines require use of cans of much smaller capacity, i.e. the cans are smaller in height or diameter or both, than those employed in the preprocessing of sliver for ring spinning. Thus, the desirability long recognized in the art of being able to pack more and yet more sliver into a can is fast becoming an economic necessity. In this, the art has suggested both means for providing a more compact layering of coils of sliver with less open space between adjacent coils and means for compacting sliver coils through compression. Sundry means have been suggested for compaction through compression, it being considered that maximum benefits can be thus obtained, such as those disclosed for example in British Pat. No. 347,448 and in U.S. Pat. Nos. 1,312,953; 1,957,241; 3,241,196; 2,780,838; and 3,233,290.

Despite recognition of all of the foregoing by the art, it has been singularly silent with respect to how one may effectively combine in automatic sequential and concurrent manner can filling, can changing, and concurrent sliver severing and compaction repetitively without disrupting the sliver and creating waste. It is to fill this void in the art that this invention is directed. Other desirable objects of the invention, their advantages and means for their attainment shall become evident through the explanations which follow.

SUMMARY OF THE INVENTION

It has now been found that the objects of the invention are attained by an operative joining of a sliver coiler apparatus and an automatic can changer, both well known in the art, with a particular sliver coil compacting device in a manner such that a particular sequence of operational steps are repetitively performable in a wholely automatic manner.

According to the invention, the sequence of operational steps starting with a sensing that a can has become filled with a predetermined amount of coiled sliver strand thereafter includes (a) stopping sliver feed to the coiler apparatus, (b) exchanging an empty can for the filled one beneath the coiler apparatus and positioning the filled can adjacent thereto and therebeyond beneath a sliver coil compactor device, (c) compressing the coils of sliver in the filled can and concomittantly attenuating the ultimate portion of sliver strand extending from the last top coil within the can and between the edge of the compactor's plunger plate and the inner wall of the can over the rim of the can and to the exit orifice of the tube gear plate of the coiler apparatus until the sliver strand portion parts, (d) starting sliver feed to the coiler apparatus and resuming the coiling of sliver into the empty can while maintaining compression of the sliver coils in the filled can for a predetermined interval, and (e) withdrawing the plunger plate from the filled can at a predetermined time which is prior to completion of the filling of the empty can.

The coiler apparatus and can changer device are conjoined in the usual manner, the latter being of any conventional inline or carousel type wherein filled cans are displaced by empty ones in linear or arcuate movement from the can filling station beneath the spectacle and tube gear plates of the coiler apparatus to the can discharged position therebeyond. The present sliver compacting device or compactor is positioned adjacent the coiler above the can discharged position such that its spectacle and plunger plates are, when the latter is in its inoperative state and withdrawn condition, at approximately the same or a somewhat higher elevation as or than that of the coiler's spectacle and tube gear plates.

The present compactor among its features includes a plunger plate of particular design having a smooth bottom face for contact with the sliver coils without snagging or otherwise disrupting them or their constituent fibers, a smooth edge surface, a smooth upper lip face extending inwardly from the edge surface and conjoined smoothly with an upstanding annular flange member. Also provided is a safety shroud which is freely movable on the plunger rod, that is joined to the center of the plunger plate, between a withdrawn position and a downwardly extending position between the elevations of the compactor's spectacle plate and the rim of the can, the shroud being supported on the upper lip face of the plunger plate when the latter is withdrawn and when the latter descends to a point below the can rim; thereafter, the shroud is supported at its downwardly extending position by stop members which encounter an inner surface of the spectacle plate of the compactor. The diameter size of the plunger plate is such as to provide a space between its edge and the can wall sufficient to admit the sliver strand to pass therebetween without being abraded.

Control means are provided to coordinate the sequential and concurrent performance of the aforesaid operational sequence of steps, and in a manner which avoids disruption of the sliver coils and resultant waste product.

THE DRAWINGS

Figure 2:
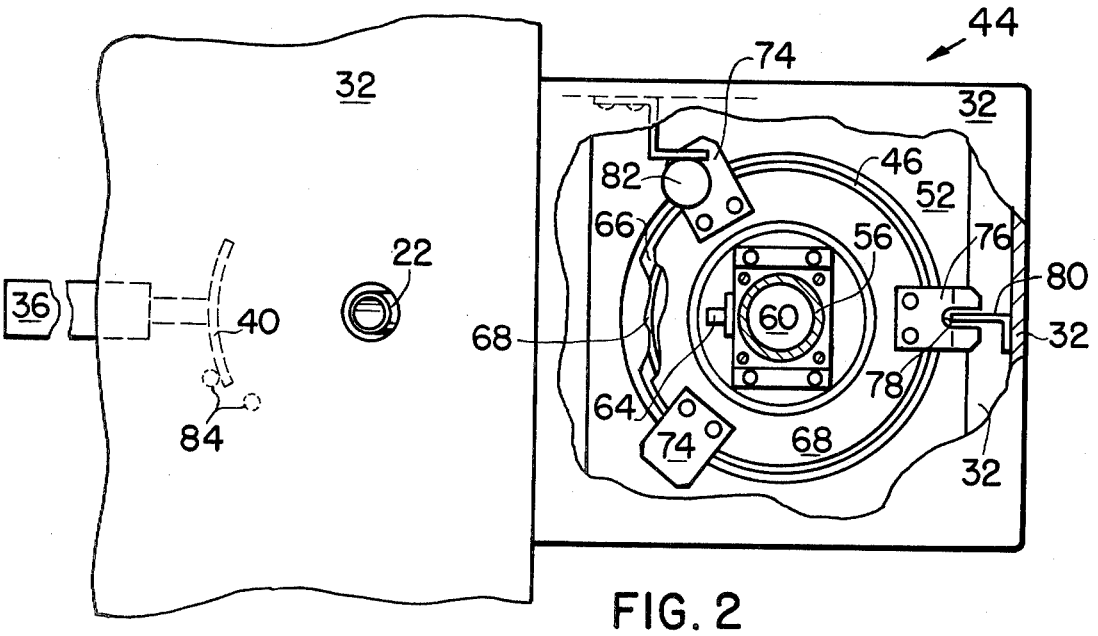
Figure 3:
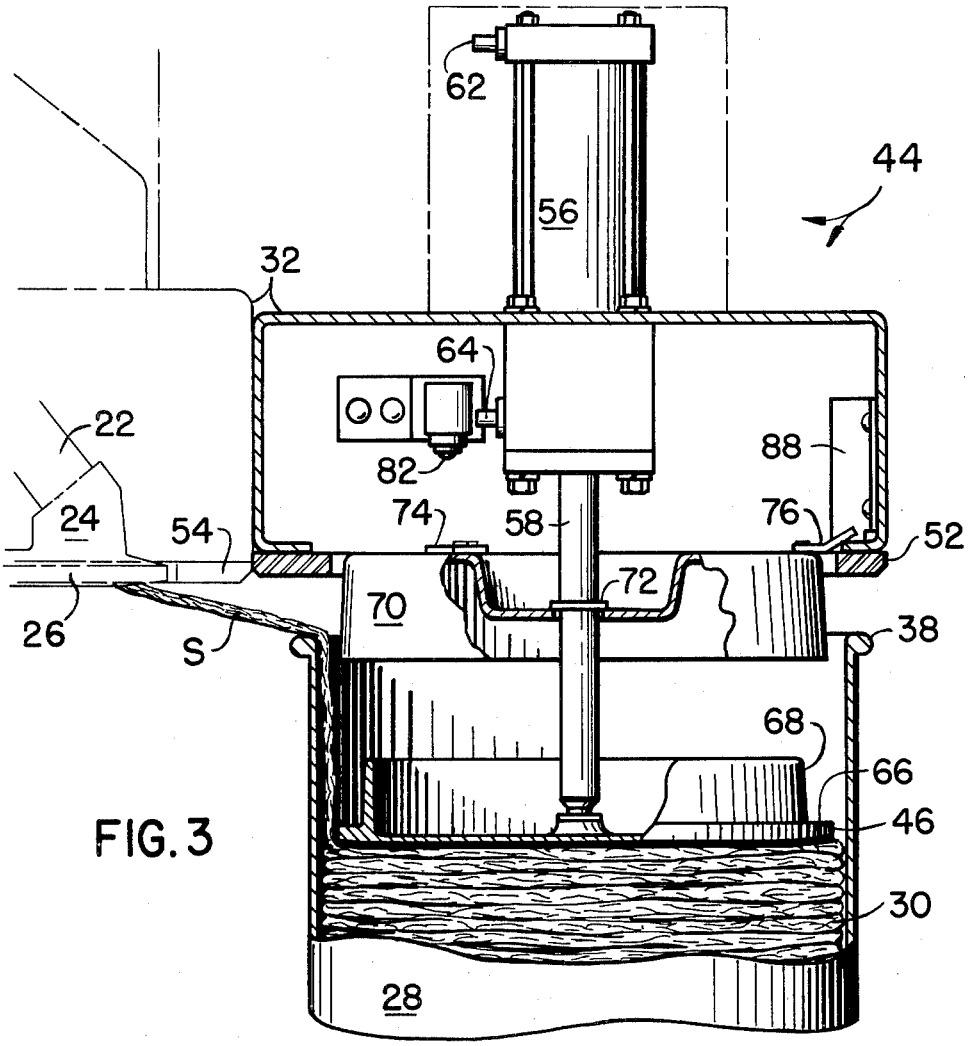
Figure 4:
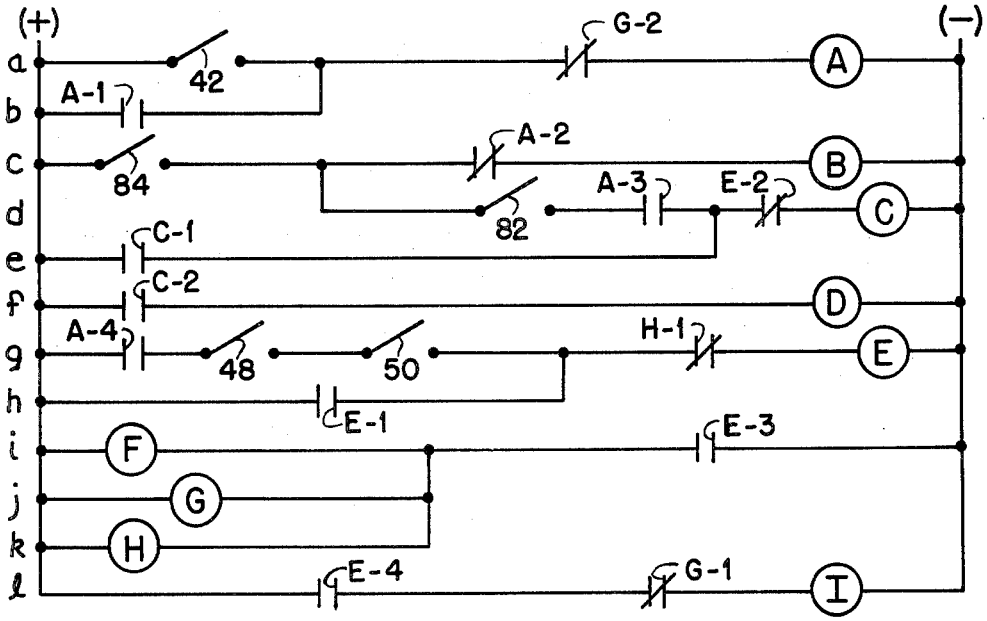

A fuller understanding of the nature of the invention and its advantages may be had from the description of the preferred embodiment when taken in conjunction with the appended drawings in which:

FIG. 1, a side elevational view partially schematic and in part broken away, shows the cooperative physical arrangement of the present invention combination;

FIG. 2, in top plan view and somewhat enlarged and in part broken away, is taken generally along line 2—2 of FIG. 1 to show some internal details of the present compactor component of the invention;

FIG. 3 is an enlarged fragmentary view of the compactor component device of FIG. 1, partially in section and partially in elevation, showing the relation of the compactor to the filled sliver can and its coiled sliver during descent of the plunger plate beyond the can rim and just prior to the attenuation parting of the sliver strand extending to the coiler; and FIG. 4 is a diagramatic representation of circuitry of the control means of the invention.

A PREFERRED EMBODIMENT

FIG. 1 depicts a typical arrangement of components of the invention in practicing its process. Therein, a sliver S is fed to a coiler apparatus 10 after being processed by a preceding machine such as draw box 12 wherein sliver S has undergone a drafting attenuation, such as by a plurality of drafting rolls 14, and passed through a condensor plate and delivery tube 16 to be received by a cooperating pair of calender feed rolls 18 of coiler 10 which are positively driven. Rolls 18 feed sliver S to and through a condensing trumpet 20 and into and through a coiler device including a coiler tube 22 and its conjoined tube gear 24 and plate 26, through the latter's exit orifice (not shown) and into a can 28 as coils 30 in a layered pattern. Draw box or drawframe 12 and coiler apparatus 10 may, as shown, share a common frame 32 and common drive (not shown), and a bottom platform member 34 for receipt of empty cans 28 into alignment one at a time at position A on member 34, the can filling position, there to remain during filling, and for support of a filled can 28 during its movement by an automatic can changer, diagramatically shown and indicated as 36, from position A to a can discharge position B spaced from the can filling position A by at least a can diameter. Coiler plate 26 together with tube gear 24 and coiler tube 22 are positively driven by conventional means (not shown) in sychronism with the driving of calender rolls 18 and drafting rolls 14 to deliver a predetermined quantity of sliver S coils 30 to can 28. According to the invention, the predetermined amount of sliver coils 30 is from twenty (20) to eighty (80) percent more of sliver S than is normally required to fill can 28 and extend beyond from its rim 38 to the undersurface of coiler plate 26. This has the effect of placing coils 30 under compression thus to increase the weight and yardage of sliver S in can 28 a like percentage beyond the "normal" capacity of can 28. By "normal" capacity is mean that weight and length of sliver S which would occupy the volume of can 28 and that between its rim 38 and the undersurface of coiler plate 26 when coils 30 are unrestrained and neither compacted nor otherwise compressed.

Detection of delivery of the aforesaid "predetermined" amount of sliver S coils 30 to can 28 may be made by any of the very many known devices commonly used therefor in the art, including hank counters or timing devices or weight measuring devices. Such devices may be connected with a stop-motion so that upon attainment of the detected predetermined amount of coiled sliver S both the preceding machine 12 and coiler 10 including its calender rolls 18 stop. In FIG. 1 such a detection device, a hank counter, and stop motion are diagramatically indicated by the block 42 and its interconnected roll in contact with one of rolls 18. Further, device 42 concomitantly actuates operation of the automatic can changer 36 to cause it to extend its pusher arm 40 and move filled can 28 from its filling position A beneath coiler plate 26 to its can discharged position B on frame platform 34 beyond plate 26 and centered beneath the present compactor device 44 and its piston plate 46. In a continuing action, when pusher arm 40 has fully extended itself it automatically may retract to its former withdrawn position and upon reaching the same actuate a resetting of detection and stop motion device 42 for subsequent filling of an empty can 28 placed or received into position A.

The accurate positioning of filled can 28 at position B concentric axially with that of plunger plate or piston plate 46 is readily sensed by any of the many diverse means readily thought of and known in the art, such as by the tripping of switches 48 and 50 set into platform 34 for engagement and closing by the bottom rim of can 28. The closure of normally open switches 48 and 50, also shown as part of the present control means' circuitry of FIG. 4, may be used to actuate operation of compactor device 44.

Device 44 is mounted beyond coiler 10 on frame 32 to overhang position B of platform 34. Its spectacle plate 52 is set on frame 32 at an elevation which is the same as or slightly greater than the elevation of the spectacle plate 54 of coiler 10 above platform 34. This is to provide a smooth continuation of constraining surfaces contacted by the topmost coils 30 within and above filled can 28 when the latter is moved from position A to position B. Alternately, spectacle plates 52 and 54 may be a single plate with two circular orifices for containment therewithin of plunger plate 46 and coiler plate 26 respectively.

With reference to FIG. 1 and more particularly to FIGS. 2 and 3, compactor device 44 includes a pressure cylinder 56 with a piston rod 58 and retainer 60 housed within, rod 58 passing from retainer plate or pressure plate 60 downwardly and out of cylinder 56 and fixed at the center of piston or plunger plate 46. To lower plunger plate 46, gas such as air under pressure is forced through upper port 62 at the top of cylinder 56 and against pressure plate 60 forcing it and conjoined rod 58 and plate 60 downward. To raise plate 46 to its withdrawn position within the orifice in spectacle plate 52, air is forced into the bottom of cylinder 56 through the lower port 64 between the gasketed bottom closure of cylinder 56 and movable pressure plate 60 to force the latter and its conjoined piston rod 58 and plunger plate 46 upward. Ports 62 and 64 are interconnected in a conventional manner with appropriate valving and a source of pressurized gas (not shown), which valving in turn is controlled by the present control means as shall later be described.

Piston plate 46 is formed with an upper peripheral lip 66 extending inwardly from the top peripheral edge of plate 46 a prescribed distance, and in this preferred embodiment about one inch (2.54 cm.). Thereat is a conjoined upstanding annular flange 68 extending above the upper surface of plate 46 a prescribed distance which is approximately the same as the distance between the upper rim 38 of can 28 and the undersurface of spectacle plate 58. The prescribed diameter of piston plate 46 is less than the inner diameter of can 28 by a prescribed amount sufficient to admit between the edge of plate 46 and the wall of can 28 inner sliver strand S without scuffing or abrasive contact of the latter with either surface of plate 46 or can 28, and in this preferred embodiment such spacing is about one inch (2.54 cm.), producing a prescribed diameter of plate 46 about two inches (5.08 cm.) less than the internal diameter of can 28. This prescribed spacing is needed not only to avoid disruption of the fibers of sliver strand S which extends between the last top coil 30 of can 28 to the orifice in coiler plate 26 leading to coiler tube 22 and calender rolls 18 when plate 46 is depressed, but also to take into account variations in the round of can 28.

The use of piston plate 46 which is retractable into the orifice of spectacle plate 52 may create an especially hazardous situation. Thus, to prevent the operative's insertion of fingers inadvertently between the lowered piston plate 46 and spectacle plate 52, a special safety shroud 70 is here provided. Shroud 70 is in the form of an inverted cup with an axial hole, positioned between cylinder 56 and piston plate 46 so that it may freely move on piston rod 58. The diameter of the lower portion of shroud 70 is sized so as to be intermediate that of plate 46 and its upstanding flange 68 so that shroud 70 may be supported by upper lip 66 of plate 46 when the latter is in its retracted position at the elevation of spectacle plate 52 and during the first portion of the downward descent of plate 46, as shall later be described. Also concentrically positioned on rod 58 between the top surface of shroud 70 and the bottom of cylinder 56, and preferrably glued to the top of shroud 70 around its central hole, is a felt wiper element 72 in loose contact with rod 58 to act as shroud 70 moves as a clearer of lint from rod 58.

In order to stabilize shroud 70 and limit its downward movement, a plurality of stop members 74, 76 are provided fixed to the upper portion of shroud 70 so as to be intercepted by the inner upper surface of spectacle plate 52, or as shown best in FIG. 3 by that portion of frame 32 at which spectacle plate 52 is joined thereto. Stop member 76 is formed with a slit 78 at its free end such that member 76 is guided by and retained by a flange member 80 fixed to a side wall of frame 32, member 80 intruding into slit 78, during upward or downward movement of shroud 70.

With reference to all figures, and especially FIG. 4, the operation of the present combination as coordinated and controlled by an exemplary control means of the invention proceeds as shall now be described.

CONTROL CIRCUITRY

FIG. 4 shows the circuitry of an example of a control means for the invention's operation. The various switches 42 at line a, 84 at line c, 82 at line d and 48 and 50 at line g are shown as "open". Switch 42, also shown in FIG. 1 as the sensing device which senses when a predetermined amount of sliver S has passed through calender rolls 18, is open during the feed of sliver S through calender rolls 18 and upon detection of passage of the aforesaid predetermined amount of sliver is then closed. Switch 84, also shown in FIGS. 1 and 2, although normally open is closed when both a can 28 is in position under the coiler plate 26 at position A on platform 34 and can changer pusher arm 40 is fully retracted. Switch 82, also although normally open is closed when plate 46 and shroud 70 are in their elevated positions within the frame 32 of compactor device 44 as seen in FIG. 1 and open when 46 and 70 have descended as in FIG. 3. Switches 48 and 50 although normally open are closed when the rim bottom of can 28 depresses them both and thus only when can 28 has been positioned precisely below and centered with plunger plate 46 at position B on platform 34.

The relays A at line a, C at line d and E at line g, as well as the solenoids B at line c, D at line f and F at line i, the short term duration time delay relay G at line j and the long term duration time delay relay H, and the electrically controlled reset device for reopening switch 42, namely device I at line l (ell) are normally in a deenergized state. The contacts of these various relays and solenoids indicated by the element letter followed by a number are normally either in an open or closed state as shown in FIG. 4 when the associated control element is in a deenergized state.

STEP (A), STOPPAGE OF SLIVER FEED

When the predetermined amount of sliver S has passed through calender rolls 18 of FIG. 1, device switch 42 thereat and at line a of FIG. 4 is closed. This permits current to flow at line a therethrough and through normally closed contact G-2 to energize relay A. Such energization causes a change in state of the contacts of relay A, thus closing contact A-1 at line b. Such closure of contact A-1 "latches" relay A to maintain it in an energized state even if, as later occurs, switch 42 is reset by its being opened. Other relay A contacts have a change in state: contact A-2 at line c is opened, contact A-3 at line d is closed and contact A-4 at line g also is closed. At this point in the process, since pusher arm 40 of the can changer device 36,40 is completely retracted and can 28 is in position under coiler plate 26 at position A on platform 34, switch 84 in FIG. 1 is closed. Thus at line c of FIG. 4, with switch 84 closed and with contact A-2 now opened by the previous energization of relay A, solenoid B is deenergized. During filling of can 26, solenoid B is in an energized state due to the closure of switch 84 and the normally closed condition of contact A-2. Solenoid B is the control element for a clutch (not shown) which effects driving interconnection between a main motor drive means (not shown) and drafting rolls 14 and coiler 10 with its calender rolls 18. Thus deenergized, solenoid B effects declutching of the aforesaid interconnection depriving rolls 14 and 18 of driving inpetus to stop them as well as stopping rotation of coiler assembly 22, 24 and 26, and also any can turntable (not shown) which may be situated in platform 34 at position A to aid in the patterning of coils 30 within can 28.

STEP (B), CAN CHANGING AND POSITIONING BENEATH COMPACTOR

At this point in the process, referring again to FIG. 4, at line c switch 84 had been closed as described, contact A-2 had been opened due to energization of relay A, and thus solenoid B had become deenergized to stop the flow of sliver S and the layering of coils 30 into filled can 28 at position A on platform 34. At line d, switch 82 (at compactor 44 of FIG. 1) is held closed by retracted compactor plate 46, and the safety shroud 70 bearing thereagainst, contact A-3 had been closed due to energization of relay A, and thus current flows through switch 84 of line c and switch 82, contact A-3 and normally closed contact E-2 to energize a relay C. Such energization produces a change in state of the various contacts C-1 at line e and C-2 at line f of relay C. Closing of contact C-1 effects a "latching" of relay C to provide continuous energization thereof despite later opening of switches 84 and 82 and contact A-3 by bypassing the same. The closing of contact C-2 at line 4 effects an energization of the control solenoid D. Control solenoid D when energized effects a change in valving (not shown) state to admit pressurized gas to cylinder 36 of the can changer assembly 36,40 of FIGS. 1 and 2 to cause piston rod and can pusher 40 to extend outwardly to bear against can 28 at position A and move it to position B on platform 34. Upon such movement, switch 84 at line c is opened. Upon can 28 arriving at position B on platform 34, its bottom rim closes both switches 48 and 50 at line g and in FIG. 1.

STEP (C), COMPACTION OF COILS AND SLIVER SEVERING

At line g of FIG. 4, with the closure of switches 48 and 50, current flows through previously closed contact A-4 of energized relay A (at line a), these switches and normally closed contact H-1 thus to energize a relay E. This energization effects a change in state of its various contacts E-1 at line h from normally open to closed, E-2 at line d from normally closed to open, E-3 at line i from normally open to closed and normally open contact E-4 at line l (ell) to closed. The closing of contact E-1 at line h effects a latching of relay E which is to say provides for a continued energization thereof despite later opening of contact A-4 and switches 48 and 50 by bypassing them.

Energization of relay E provides for the occurrence of a number of events, which shall be treated ad seriatim, of concurrent and sequential nature. The change in state from closed to open of contact E-2 at line d effects in turn an interruption of current to relay C at line d to deenergize it. Thus, its contacts C-1 at line e and C-2 at line f are returned to their original state and are opened. The opening of contact C-2 at line f interrupts current to solenoid D to deenergize it and thus effects a change in valving (not shown) to its original state to cause the retraction of piston can changing pusher element 40 to its retracted position of FIG. 1. The closing of contact E-3 effects an energization of three control elements, compactor solenoid F at line i, the "short cycle" time delay relay G at line j and the "long cycle" time delay realy H at line k. Also, the closing of contact E-4 at line l (ell) permits current to flow therethrough and through normally closed contact G-1 to energize yet another solenoid I. Solenoid I is the control element which effects a resetting of the sliver counter and stop motion device and its switch 42 to open the latter. This resetting and reopening of element 42 is virtually instantaneous.

The energization of solenoid F effects a change in valving (not shown) as previously described between ports 62 and 64 of cylinder 56 of the compactor device 44 (FIG. 3) so as to admit pressurized gas, usually air, to the top portion of cylinder 56 to force pressure plate 60 (FIG. 2) and its conjoined piston rod 58 downward, together with conjoined plunger plate 46. Plate 46 thus is forced against the layers of coils 30 in can 28 to compress them.

As plate 46 descends, shroud 70 supported upon lip 66 also descends by gravity. As soon as shroud 70 begins to descend, it moves out of contact with switch 82 to open the latter. Continued movement of plate 46 carries with it shroud 70 until movement of the latter is stopped by impingement of elements 72, 74 and 76 against the lower portion of frame 32 to which spectacle plate 52 is attached (FIGS. 2 and 3). At this time, shroud 70 covers the space between rim 38 and spectacle plate 52 preventing the intrusion of fingers or other implements thereinto.

The valving (not shown) which is controlled by solenoid F is of a conventional type wherein the pressurized gas is throttled so as to be admitted to the upper portion of cylinder 56 at a relatively slow rate, thus permitting the slow descent of compactor plate 46. This descent then is time controlled until full extention of piston rod 58 is achieved, which full extention may be as great as from one-third to one-half the height of can 28, and can be preset as desired. The timing of descent of plunger plate 46 is critical to proper operation of the invention in two regards. First, such slow descent permits the slow compression of coils 30 and in so doing the slow expiation and expulsion therefrom of occluded air in a manner which by its nature avoids disruption of the coils and intermingling of fibers of adjacent coils. It minimizes ballooning out of sliver fibers of the topmost coils 30 into the space between the inner wall of can 28 and the outer edge of plate 46, which ballooning can be disruptive. Secondly, the rather slow descent, usually about twenty to thirty seconds long, permits a slow attenuation of the ultimate strand of sliver S extending between the last topmost coil 30 and the static nip point created where strand S bends about the edge of the orifice in coiler plate 26 and enters element 24. Through repeated trials it was observed that a most beneficial result occurs in this practice, that by such slow descent and consequent attentuation of strand S, strand S will part between a nip point where strand S bends about rim 38 of can 28 and where it enters element 24. Thus, later when it is desired to thread up the end of strand S at a subsequent machine for further processing the end leading to the topmost coil in can 28 is separate from the mass of coils and is readily accessible. Further, when later in this process coiling of sliver S into an empty can 28 is to be resumed, the end of sliver S at the coiler position A which shall be the first portion to be coiled is small and in position to be placed immediately into such empty can, thus avoiding any waste. It has further been found that, depending upon the type of sliver being processed and its staple length, strand S will part prior to full extention of piston rod 58, when such extention is between ten to fifty percent of the height distance of can 28. For the most commonly processed slivers S as to type and staple length, such attentuation parting of the strand will occur when, as mentioned, the extention is between twenty and fifty percent, and most usually by extention of about thirty percent of the height distance of can 28. One can now readily appreciate the requirement of this invention that compactor 44 be fixed adjacent coiler 10 with their respective spectacle plates 52 and 54 and coiler and plunger plates 26 and 46 be mounted at approximately the same elevation above can 28.

Even in the aforesaid slow descent of plate 46 onto coils 30 and into can 28, it is observed that some ballooning of sliver may occur into the space between the circumferential edge of plate 46 and the inner wall of can 28. The extent of such ballooning appears to be dependent not only upon the rate of descent of plate 46 but also upon the type of sliver S, such as the type of constituent fibers thereof, the sliver weight per unit length, the resiliency of sliver S, the "tightness" of coils 30 and their degree of initial packing in can 28 during coiling, and also upon the distribution of staple fiber lengths and the average staple fiber length of sliver S. Thus, in order to obviate a problem which may occur in a subsequent step in the present process, namely the withdrawal of plate 46 from can 28 and to its withdrawn elevation of that of specatcle plate 52, this problem being the entrapment of sliver (which may have ballooned during the present step of descent and its rising with plate 46 subsequently during withdrawal) between the peripheral edges of plate 46 and spectacle plate 52 at the orifice of the latter, the invention has provided upstanding flange 68 on the upper face of plate 46. Such flange 68 acts to restrict the extent of overlapping of any ballooning sliver onto the top surface of plate 46 to the upper surface of lip 66. It has been found moreover that such limitation is so effective that upon retraction at a later step of piston 58 and plate 46, the sliver so ballooned is withdrawn from overlapping during the rise of plate 46 such that when the upper surface of lip 66 encounters the bottom edge of shroud 70 (FIG. 3), the sliver is not entrapped therebetween.

STEP (D), RESTARTNG COILING AND MAINTAINING COMPRESSION

Returning to FIG. 4, relay E had been energized causing retraction of the can changer piston pusher 40 through deenergization of relay C and then solenoid D, as well as the resetting by opening of switch 42 of the sliver measuring and stop-motion device of FIG. 1 after a short delay through the energization of "short cycle" time delay relay G at line j and the thus delayed energization of solenoid I at line l (ell). What then is required to restart coiling is a reenergization of solenoid B which effects a reclutching of the main drive (not shown) to interconnect such drive with draw box or frame 12 and coiler 10. Thus, line c requires that open switch 84 (also, FIGS. 1 and 2) and contact A-2 must be closed. Switch 84, as may be seen in FIGS. 1 and 2, has two contact switch elements (unnumbered) which are in electrical series with one another; the left hand switch element has been closed by contact with the now retracted can changer piston pusher element 40. At this stage in the process, either automatically as a function of unshown elements of the can changer or manually an empty can 28 is placed into position A on platform 34 beneath coiler plate 26. This causes contact between can 28 at that position and the right hand contact element of switch 84 thus closing switch 84. As mentioned, these events occur during the short interval of delay in the energization of "short cycle" time delay relay G at line j.

Thus, when relay G has "timed out" and becomes energized it effects a change in state of its contacts G-1 from normally closed to open at line l (ell), and G-2 in similar fashion at line a.

The opening of contact G-1 thus effects a deenergization of solenoid I and in so doing prevents any further resetting of the sliver amount sensor switch and stop motion 42 during the process step of refilling of the empty can 28 at position A in the cycle of operations.

The opening of contact G-2 at line a causes an interruption of current through closed contact A-1 at line b to relay A at line a thus deenergizing relay A. This causes a change in state of relays A's contacts A-1 to once again open it at line b, A-2 at line c once again closing it, A-3 at line d once again opening it and A-4 at line g once again opening it. In this, the opening of contact A-1 "unlatches" relay A.

Thus, with the reclosing of contact A-2 at line c coupled with the previous closing of switch 84 by placement of an empty can 28 at position A the requirements are met to reenergize solenoid B which causes resumption of sliver feed and coiling into empty can 28.

Further, the aforesaid energization of relay E and consequent closure of its contact E-3 at line i effects the flow of current to "long cycle" time delay relay H at link k, to start the timing delay in such relay H prior to its energization. This timing delay is so selected so as to be less by a desired amount than the known time which is required to deliver to and fill can 28 with the hereinbefore predetermined amount of sliver.

STEP (E) COMPACTOR PLUNGER WITHDRAWAL

At this point in the process at line a, switch counter 42 has been reset and is now counting sliver being delivered to the now filling can 28 at position A; contact G-2 has been opened and thus relay A has been deenergized. At line b, contact A-1 has been reopened. At line c, switch 84 is closed due to the presence of can 28 at position A and the retraction of can changer piston pusher 40, contact A-2 has been restored to its normally closed condition and thus solenoid B is energized which permits feed of sliver S to coiler 10 and filling of can 28 at position A with coils 30 of sliver S. At line d, switch 82 is opened due to the descended position of shroud 70 and the continued compression of coils 30 in can 28 at position B; contact A-3 had been returned to its normally open condition and contact E-2 had been opened thus to deenergize relay C. The latter effects, at line e, the reopening of contact C-1 to remove "latching" from relay C. Deenergization of relay C also, at line f, reopens its contact C-2 which effected deenergization of can changer solenoid D to retain piston pusher 40 in its retracted condition. At line g, contact A-4 had been reopened nullifying the effect of closed switches 48 and 50 along this line on relay E, switches 48 and 50 being closed by filled can 28 at position B. However, also at line g, contact H-1 was opened when after the hereinbefore defined delay of relay H at line k had timed out energizing relay H. Up until the instant of such timing out, however, contact H-1 was in its normally closed condition and relay E was thus in an energized state through, at line h, closed contact E-1 which latched relay E. Further, at lines i to k, the consequent closing of contact E-3 had permitted current to flow to compactor solenoid F to maintain compression of coils 30 in can 28 at position B, to "short cycle" time delay relay G to, at this time, have it in an energized state, and to "long cycle" time delay relay H, which at this time had not "timed out" and thus has not as yet been energized.

As mentioned, upon timing out for the period desired to maintain continued compression of coils 30 of can 28 at position B, relay H is energized to thus open, at line g, contact H-1.

Opening of contact H-1 deenergizes relay E (line g). This effects at line d, the reclosing of formerly open contact E-2, which however has no further effect on previously deenergized relay C. At line h, contact E-1 is restored to its normally open condition. At line i, however, the consequent restoration of contact E-3 to its normally open condition immediately deenergizes the compactor solenoid F control. Such deenergization effects a change in valving between the source of pressurized gas (not shown) and cylinder 56 of compactor 44 to pressurize the lower portion through port 64 thus to force pressure plate 60 and conjoined rod 58, plate 46 and shroud 70 upward until the latter elements are in their withdrawn position as in FIG. 1. This effects, at line d, to reclose switch 82 as shown in FIG. 3. Deenergization at line j of relay G due to reopening of contact E-3 at line i effects, at line l (ell), the consequent reclosing of contact G-1, and the reopening of contact E-4 retaining reset I in a deenergized condition.

Thus, all conditions are as was described at the beginning of step (a), excepting only that switches 48 and 50 are closed at line g due to the presence of filled can 28 at position B.

Withdrawal of plate 46 from can 28 at position B may proceed at any convenient rate without disturbing the coils 30 of sliver. In such retraction, any sliver which may have blossomed out between the peripheral edge of plate 46 and can 28 and onto lip 66, as plate 46 is raised is pulled back from lip 66 and the aforesaid space. Here it has been observed that the gradual rising of sliver coils 30 as plate 46 is withdrawn is at a lower rate than that of plate 46 thus to induce the aforesaid "pulling back."

That which is claimed is:

1. In combination with a conjoined coiler apparatus and an automatic can changer apparatus, respectively for filling a can with a strand of coiled sliver and for the replacement of said then-filled can with an empty one, means for compacting coils of said sliver strand within said filled can and for concurrently causing the parting in two through attenuation of that portion of said strand extending between said filled can and said coiler apparatus, said means including a compactor plate which is extendible into said filled can to compact said coils and is then withdrawable therefrom, and means for controlling and coordinating the said elements of the heredefined combination for their sequential and automatically repetitive operation in cycles of can filling, can changing, sliver compacting and sliver parting, said control means including means for controlling the movement of said compactor plate within and above said filled can at a prescribable rate whereby expulsion of air from said sliver coils in turn is at a rate which precludes disruption of said sliver.

2. The combination as in claim 1, wherein said control means for said elements thereof further includes means for actuating movement of said compactor plate into said filled can and for maintaining said compactor plate at its full depth of incursion in said can for a prescribed interval of time which is less than the interval of time which said coiler apparatus requires to fill an empty can with said sliver coils.

3. The combination as in claim 1, wherein said control means for said elements thereof further includes means for actuating withdrawal of said compactor plate from said can and for withdrawing said compactor plate at a prescribable rate which is greater than the rate at which said coils compacted rise during said withdrawal.

4. The combination as in claim 1, wherein said control means for said elements thereof further includes means for detecting the delivery of a prescribable filling-amount of sliver by said coiler apparatus to said can therebeneath and for then stopping said delivery, means for detecting the correct positioning of said empty can beneath said coiler apparatus, and means for detecting the correct positioning of said filled can beneath said compactor plate.

5. The combination as in claim 1, wherein said control means for said elements thereof further includes means for sensing the complete withdrawal of said compactor plate from said can.

* * * * *